US005413154A

United States Patent [19]

Hurst, Jr. et al.

[11] Patent Number: 5,413,154

[45] Date of Patent: May 9, 1995

[54] PROGRAMMABLE MODULAR SYSTEM PROVIDING CONTROLLED FLOWS OF GRANULAR MATERIALS

[75] Inventors: Billy J. Hurst, Jr., Mandeville, La.; Kenneth M. Waters, Jr., Carriere, Miss.

[73] Assignee: Bulk Tank, Inc., Covington, La.

[21] Appl. No.: 135,643

[22] Filed: Oct. 14, 1993

[51] Int. Cl.[6] ..... B28C 7/04

[52] U.S. Cl. ..... 141/83; 141/105; 141/106; 141/72; 141/256; 222/58; 177/70

[58] Field of Search ..... 141/1, 83, 105, 104, 141/106, 231, 382, 387, 256, 71, 72; 222/77, 55, 58, 412, 413; 366/18, 141, 117, 120, 123; 177/70

[56] References Cited

U.S. PATENT DOCUMENTS

| | | | |
|---|---|---|---|
| 2,800,252 | 7/1957 | Wahl | 222/55 |
| 3,949,863 | 4/1976 | Lippi | 198/104 |
| 4,044,920 | 8/1977 | Swartzendruber | 222/58 |
| 4,222,498 | 9/1980 | Brock | 222/58 |
| 4,427,133 | 1/1984 | Kierbow et al. | 222/77 |
| 5,240,324 | 8/1993 | Phillips et al. | 366/141 |
| 5,265,763 | 11/1993 | Heinrici et al. | 222/77 |

*Primary Examiner*—Ernest G. Cusick
*Assistant Examiner*—Steven O. Douglas
*Attorney, Agent, or Firm*—Lowe, Price, LeBlanc & Becker

[57] ABSTRACT

Apparatus and method are provided for storing selected quantities of granular materials, for programmable extraction in selected proportions and at selected rates, for delivery to a changeable location through a flexible auger-driven common delivery conduit. Individual containers containing specific granular products are mounted so that they are continually weighed by load cells communicating with a central control system including a microprocessor. Each of the containers is provided with an individual valve which is controllable by the microprocessor pursuant to a user-provided program, so that precisely determined and timed gravity-assisted extraction of the granular materials is effected. Auger mounted immediately below each container to positively transfer the extracted granular material along the delivery conduit. By the addition of a liquid carrier, either from one of the cooperating containers or after delivery of the granular material to the selected location, slurries, e.g., drilling mud, can be formed to selected, time-varying compositions. The individual containers may have their contents replenished in place or, at the user's option, the containers may be physically removed and replaced by other loaded containers containing the same or different granular materials to suit the user's specific needs. Agitators to facilitate gravity-assisted flow of the granular materials may be provided in the individual containers.

26 Claims, 7 Drawing Sheets

PROGRAMMABLE MODULAR SYSTEM PROVIDING CONTROLLED FLOWS OF GRANULAR MATERIALS

FIELD OF THE INVENTION

This invention relates to apparatus for containing and delivering on demand flows of granular materials, and more particularly to a programmable, computer-controlled, modular system for providing controlled flows of a plurality of granular materials.

BACKGROUND OF THE PRIOR ART

There are many manufacturing circumstances where predetermined quantities of granular materials must be provided to different locations where the materials are to be put to specific use. Examples of manufacturing methods requiring the blending of one or more granular or powdered materials with a carrier material include blending a paint by mixing assorted particulate fillers or dyes with a carrier fluid, mixing different powdered ingredients to form a blended fertilizer, forming explosive materials, blending quantities of coffees and/or additives, or providing controlled flows of powdered materials to form drilling mud.

A common factor in all such applications is that one or more granular materials has to be contained and controlled quantities thereof extracted and delivered at a distance. The supply is periodically replenished as needed. Precise control must be exercised over the timing and flow rates of individual material deliveries, and also over the sequence of the controlled deliveries.

Many granular or powdered materials in dry form are typically contained and transported in sacks of varying standardized sizes. The simplest technique for using such materials is for individual workers to lift and manipulate individual sacks over a funnel or other inlet, cut the sack and pour out a quantity of the contents to weigh the same. The weighed particulate material is then moved by conventional moving means, e.g., a conveyer belt, an auger, or the like, to a point where it combines with one or more other granular or liquid carrier materials. The problem with this long-used technique is that there is often spillage and consequential waste in handling the materials. This adds to the overall costs, not just because of the value of the wasted material, but also because it takes manpower to clean up spills. Spillage of certain materials can also pose health and/or fire hazards. Even further, where relatively large quantities of one or more granular materials must be handled with significantly different quantities of other granular materials, the necessary synchronization of deliveries can be difficult, time-consuming, and expensive.

For certain simple applications, e.g., repeatedly delivering set quantities of a single granular material to a single reception point, there are a number of well-known handling systems and methods. Many applications are more complex and may involve varying flow rates, materials of different average particle size, and multiple or movable delivery locations in use. There is, therefore, a real need for a programmable, modular system which selectively operates one or more modular units in cooperation to enable a single human controller to deliver different particulate, powdered or granular materials at selected respective rates to a number of delivery points while avoiding the inconvenience, cost and difficulties of spillage and waste.

The apparatus and method according to the present invention are intended to address this need.

SUMMARY OF THE INVENTION

Accordingly, it is a principal object of the present invention to provide a programmable system including a replenishable container for containing up to a predetermined maximum quantity of a granular material, controllably delivering the material therefrom, and continually weighing the contained material before and after each delivery, with input and output data readily available to an operator of the system.

A further object of this invention is to provide apparatus in which a number of cooperating units each provide containment, continual weighing, controlled delivery, and computer-assisted operation to allow a user continuous monitoring of the availability, individualized deliveries, and other related parameters to suit specific needs.

An even further object of this invention is to provide a modular system including a number of cooperating units as described above, each supplying respective granular material, with spillage-free transportation of the granular material via a flexible delivery conduit, and easy programming of weight, time, rate, and material selection instructions by a user to control the system.

It is a related objective of this system to provide a method for containing, weighing, and delivering selected amounts of one or more contained granular materials, at selected rates and at selected times, to a selected delivery point under computer-assisted control by a user.

It is another related object of this invention to provide a method by which a single operator can program a computer to continually weigh contained quantities of different granular materials, to programmably extract selected quantities of the various materials, to convey them in selected order to a common delivery point, and to do so in a manner that insures against spillage and waste of the handled materials.

These and other related objects of the present invention are provided in a preferred embodiment by a modular system which includes a system for delivering a controlled flow of a granular material. The system includes a container means for containing a quantity of the granular material; support means for supporting the container means with the granular material contained therein; weighing means for continually weighing the support means and the container means supported thereon; and material delivery means, cooperating with the container means, the support means and the weighing means, for delivering a predetermined weight of the granular material from the container means to a selected delivery location. Programmable control means are provided for receiving, storing and processing data and instructions from a user relating to the predetermined weight and at least one other delivery-related parameter, for controlling the flow of the granular material from the container means to the selected delivery location.

In another aspect of this invention, the above objectives are met by providing a method including the steps of containing a quantity of said granular material in container means having an inlet opening and an outlet opening, supporting said container means so as to permit controlled opening of the outlet opening to obtain an outflow of said granular material therethrough, continually weighing the container means and its contents as supported by the support means, so that the weight of as supported by the support means, so that the weight of the outflow of granular material can be continually determined, and controllably transferring the outflowed granular material according to a predetermined program to a selected changeable location.

The above-listed objects and aspects of the present invention will be understood from the following description which should be read with appropriate reference to the accompanying drawing.

DETAILED DESCRIPTION OF THE PREFERRED EMBODIMENTS

Figure 1:
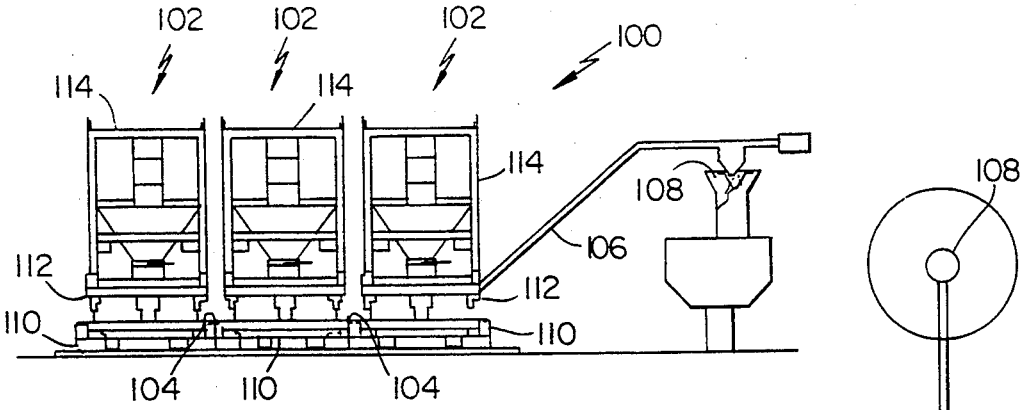
FIG. 1 is a side elevation view of an exemplary system according to this invention, comprising three cooperating modular units to provide respective granular materials to a common delivery point.

In the side elevation view of an exemplary modular system 100, best seen in FIG. 1, there are provided three modular units 102,102,102 which for convenience are disposed immediately adjacent to each other and may be interconnected by any conventional means such as bolts or clamps (not shown) at suitable locations such as 104,104. Such interconnection ensures secure and compact location of the cooperating units, and prevents shifting due to vibrations and forces that may be generated during operation of the system and/or by occasional inadvertent contacts by work vehicles passing nearby.

In the illustrated system, there is provided a single common delivery conduit 106 through which granular materials obtained from any of all of the three units 102,102,102 may be conveniently transferred to a delivery location such as 108. This common delivery conduit 106 may be made of flexible construction, e.g., with flexible metal reinforcement and a flexible outer wall made of a tough plastics material optionally combined with a flexible reinforcement fabric. Such a flexible conduit, by movement of its distal delivery end by any conventional means, may be employed to deliver an outflow of granular material to a changeable delivery location within a range determined by the length of delivery conduit 106 and its flexibility.

Each unit 102 comprises a weigh-skid 110 resting on a floor or other strong support surface. A container support base 112 rests on the corresponding weigh-skid 110, and a granular material container 114 rests on the corresponding support base 112 and, thus, on the corresponding weigh-skid 110.

Figure 2:
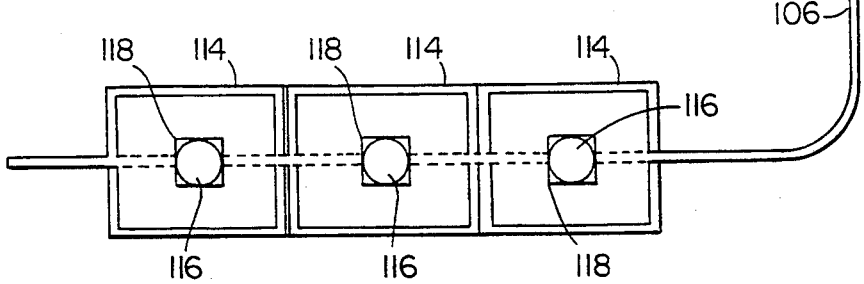
FIG. 2 is a plan view of the exemplary modular system according to FIG. 1.

As best seen in the plan view of FIG. 2, each of the containers 114 has at an upper surface an inlet opening 116, which preferably has a cover 118 to prevent ambient pollution by dust leaking out from the container and to prevent the ingress of ambient dust into the container. The cover 118 may be physically removable or hinged, and may be moved to permit periodic replenishment of granular material removed from the container 102 during operation of the system.

Each container 114 preferably has an outer portion that serves as an exoskeleton comprising, for example, upright portions 120 and horizontal portions 122 at the bottom, 124 thereabove, and 126 at the very top. Within the volume defined by such an exoskeleton, there are provided upright container walls such as 128 and 130. Below about mid-height, the side walls of container 102 are preferably inclined inwardly in sections 132,132, to create a tapered or funnel-like lower containment space to facilitate gravity-induced outflow of granular material from the container. Reinforcement and/or bracing components such as 134 may be provided at suitable locations to enhance the overall stiffness and strength of the container 102 and, for example, to provide support to an external ladder 136.

It must be understood that although the preferred embodiment per FIGS. 1–4 illustrates a generally cubical outer form for container 102, other horizontal cross-sections for the container space, e.g.,circular or oval, may optionally be chosen. It is preferred that the lowest portion of the containment space have walls which are inclined so that the contained granular material will have a tendency to flow downward. Persons of ordinary skill in the art will appreciate that there are numerous commercially available agitators, powered electrically or hydraulically, which may be disposed within the contained granular material and actuated to impart vibratory forces to the granular material to facilitate gravity-assisted outflow thereof. The selection of such agitators is a matter of choice for the user, depending on considerations of the type of granular materials involved, cost, and the like. One such agitator 138 is indicated in phantom lines in the view of FIG. 4.

As will be appreciated, container 102 may be made of metal, e.g., by welding, or may be formed by molding a strong plastics materials, e.g., nylon or the like, in known manner. Depending upon the material chosen, an element such as ladder 136, intended to provide access for inspection of upper portions of the container, e.g., inlet opening 116 and cover 118 thereof, may also be made of metal or molded-in the plastics material. To facilitate lifting and movement of container 102, especially if it is made of a metal, there may be provided hook engagement rings 140,140 to which can be temporarily attached hooks liftable by an overhead crane or the like. In the alternative, horizontal open channels may be provided, as part of either horizontal bracing elements 124 (with one on each side of container 102) or of bracing elements 134. A conventional fork-lift truck having two horizontal forwardly extended lifting prongs may then be used to physically lift and transfer such a container 102 in known manner.

At the lowest portion of the containment space defined in container 102, i.e., below the inclined side walls 132,132, there is provided a butterfly valve assembly 142 located above a sealing flange 144.

Figure 5:
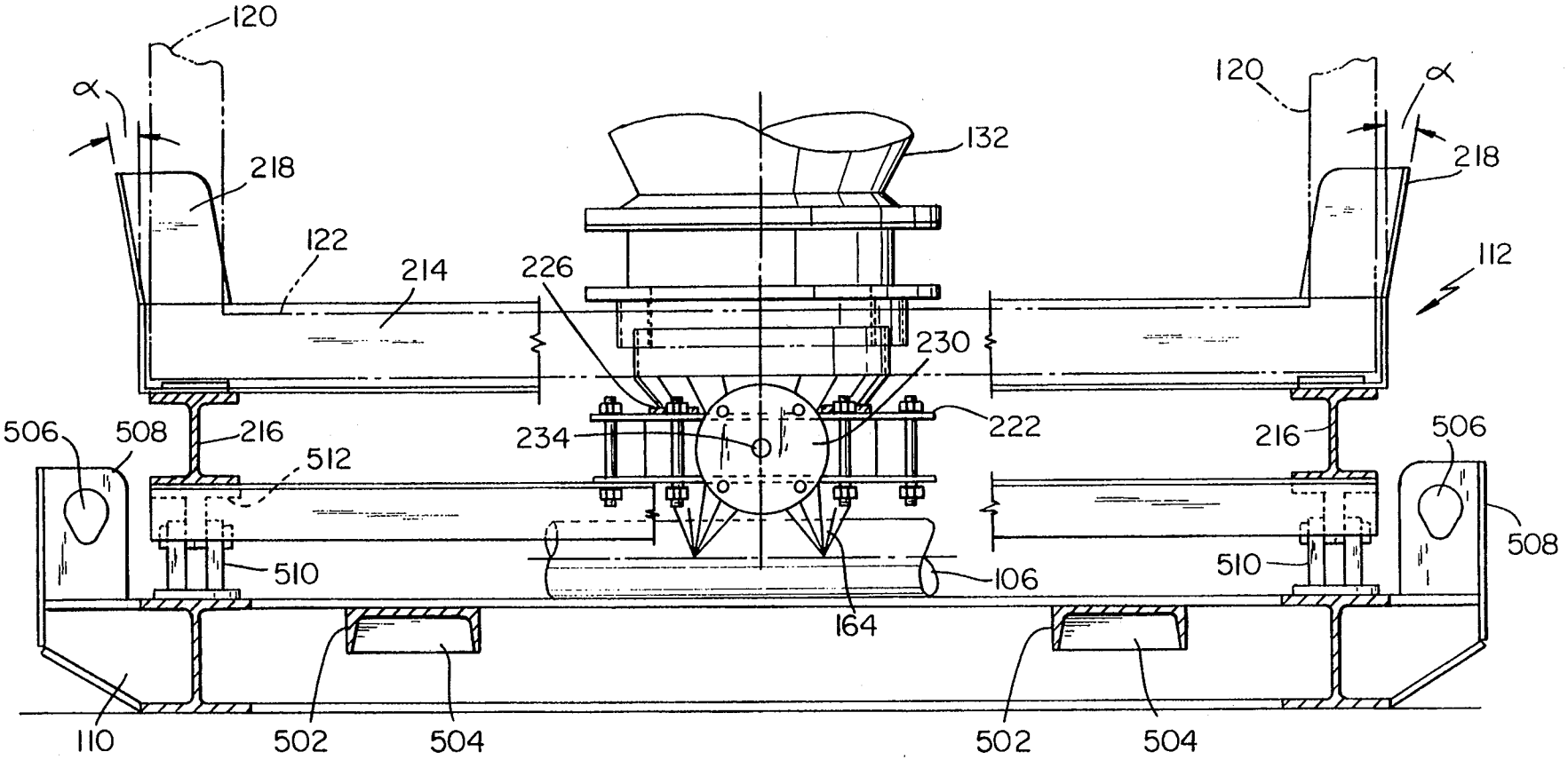
FIG. 5 is an enlarged view of a weigh-skid and a platform thereon for guidedly receiving and supporting the container of FIGS. 3 and 4 in use.

FIG. 5 is an enlarged side elevation view of the lowest portion of an exemplary unit 102. Weigh-skid 110 may be formed of welded steel I-section elements to have a base surface resting on a floor. To facilitate lifting and/or movement of weigh-skid 110, there may be provided reinforcement elements 502,502 to define reinforced apertures 504,504 spaced apart so that a conventional fork-lift truck with two forwardly extending horizontal prongs may easily engage with the weigh-skid 110 thereat. Alternative or additional hook-engaging apertures 506 may be provided in extensions 508 on opposite sides of weigh-skid 110. A convenient size for the weigh-skid 110 according to the preferred embodiment is approximately 5 ft.×5 ft., although other sizes may prove suitable for specific applications.

At an upper surface of weigh-skid 110 there are mounted four load cells 510 of known kind, one at each corner. See also the plan view of weigh-skid 110 per FIG. 10, and the enlarged side elevation view per FIG. 8.

Figure 8:
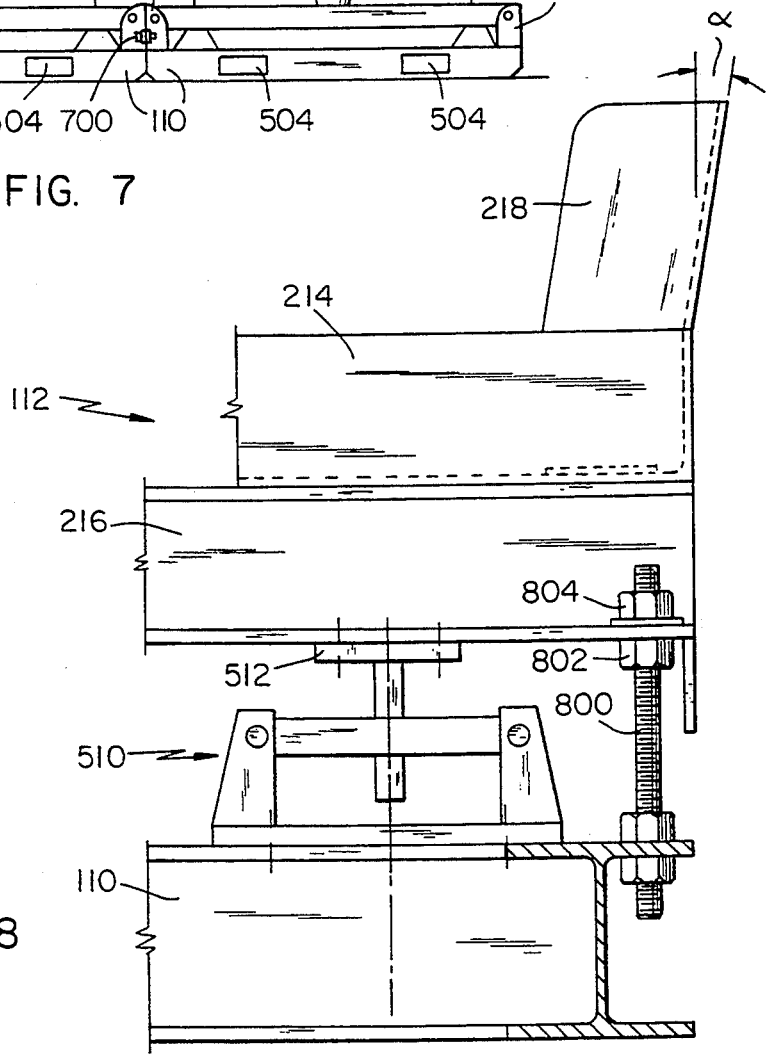
FIG. 8 is an enlarged view of a portion of the weigh-skid and container support platform thereon, to illustrate details of an exemplary load cell.
Figure 9:
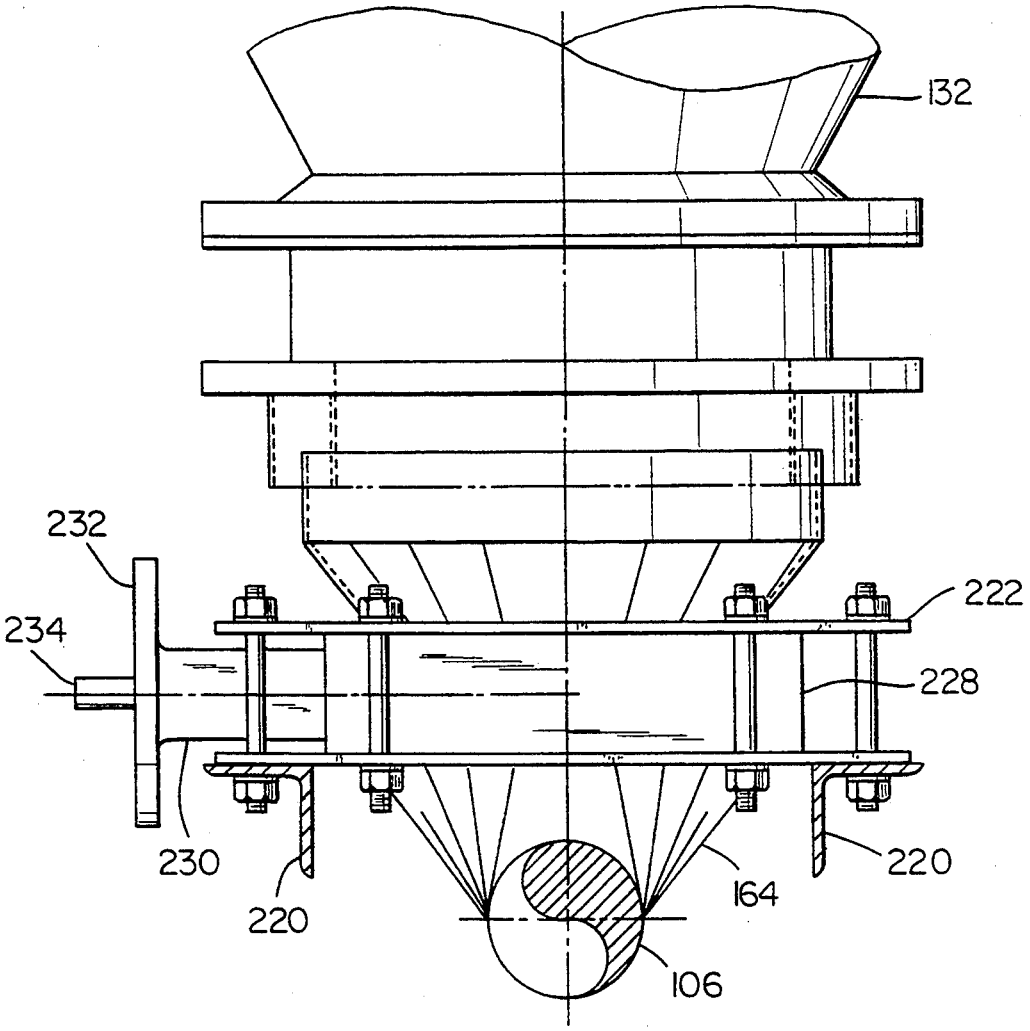
FIG. 9 is a vertical elevation view of a junction between a container and a valve and auger mechanism cooperating with the container platform and weigh-skid according to a preferred embodiment of this invention.

Each load cell 510 has a load-receiving element 512 on an upper surface of which a load to be supported by the weigh-skid 110 may rest. As best seen in FIGS. 5 and 8, container support base 112 rests on the four load bearing elements 512 of weigh-skid 110. To ensure that support base 112 does not shift out of place during use, especially when a container 102 is being placed thereon or lifted therefrom, at each corner adjacent to one of the load cells 510 there is preferably provided an upright threaded stud 800 mounted to weigh-skid 110 and extending through holes formed at corresponding locations in a lower portion of support base 112.

By the use of conventional nuts 802 and 804, it is thus possible to selectively lock support base 112 to the corresponding supportive weigh-skid 110. Then, after a loaded container 102 is placed on support base 112, nut 802 at each corner can be loosened so that the weight of support base 212 and the loaded container 102 supported thereby is gently applied to the corresponding adjacent load cell 510. Persons of ordinary skill in the mechanical arts will appreciate that by thus avoiding excessive shock loading onto load cells 510 every time that a loaded container 102 is placed on them, the useful life and reliability of output of each load cell is significantly enhanced and extended. Once a loaded container is thus placed, and the load transferred to the corresponding load cell, the upper nut 804 may also be loosened so that as granular material is extracted from that particular container 102, and the inherent elasticity in the cooperating elements of a conventional load cell 510 tends to lift load supporting element 512 thereof, the load cell 510 will continue to accurately determine the weight of the load thereon. Such protective measures and techniques are helpful in assuring long-term reliable operation of the system according to-the preferred embodiment.

Figure 11:
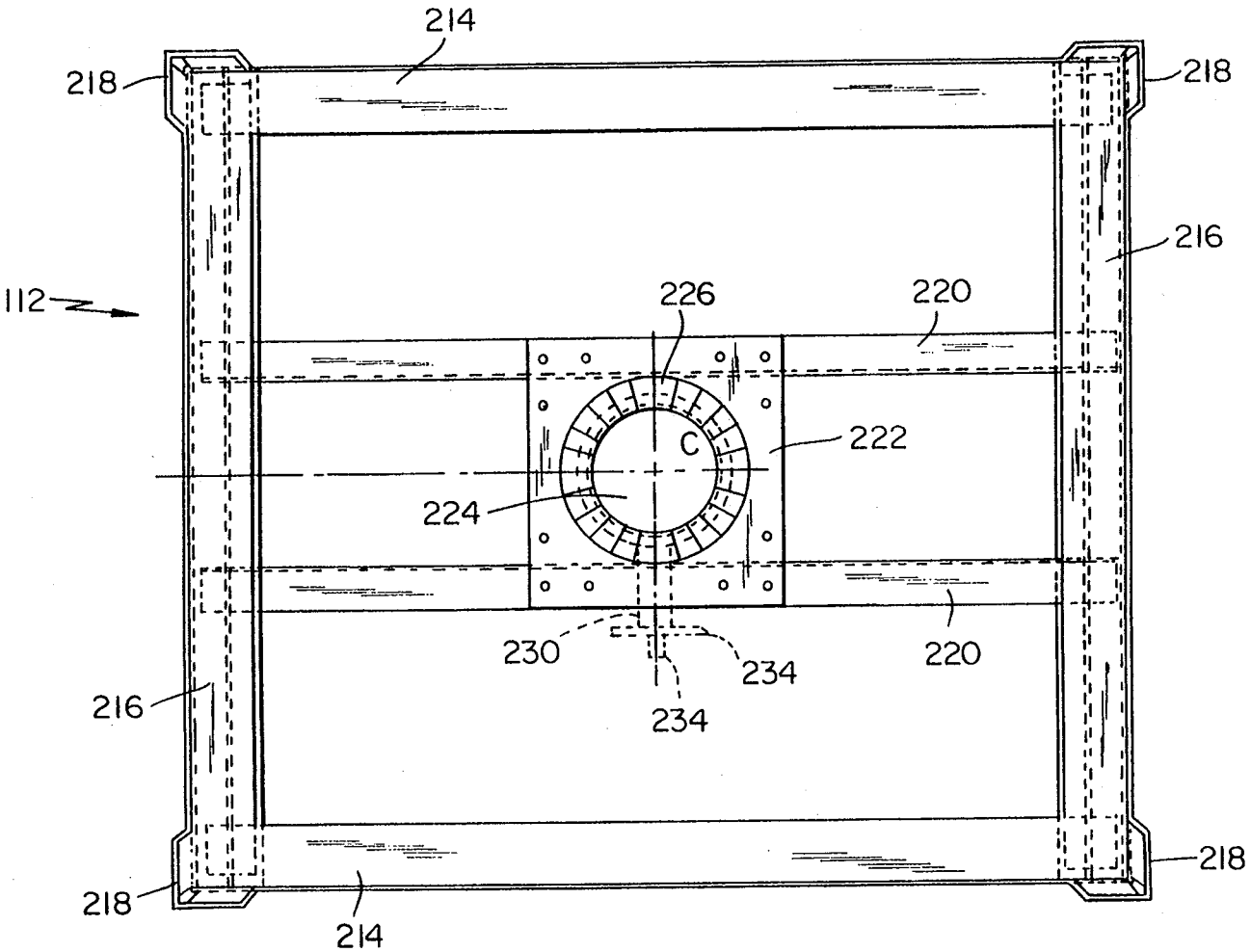
FIG. 11 is a plan view of a container support platform, to be mounted over the weigh-skid of FIG. 10, according to a preferred embodiment of this invention.

As best seen in FIGS. 5 and 11, in the preferred embodiment the support base 112 has a rectangular outer framework formed of L-section elongate elements 214 preferably welded to I-section elongate elements 216. Other comparable, light but strong and rigid, structures may be substituted therefor. The key is that base support 112 must be strong enough to support, with an adequate factor of safety, a fully loaded container 102 and, at the same time, evenly communicate the load to the load cells of weigh-skid 110 below.

At the four corners of support base 112 there are provided channel-section generally upright guide elements 218, each inclined outwardly by a small angle "α" which may be in the range of up to 25°. The outward inclination of guide elements 218 serves the function of guiding the lower-most portion of a container 114 placed on support base 112, as is readily appreciated by reference to FIG. 7.

Figure 7:
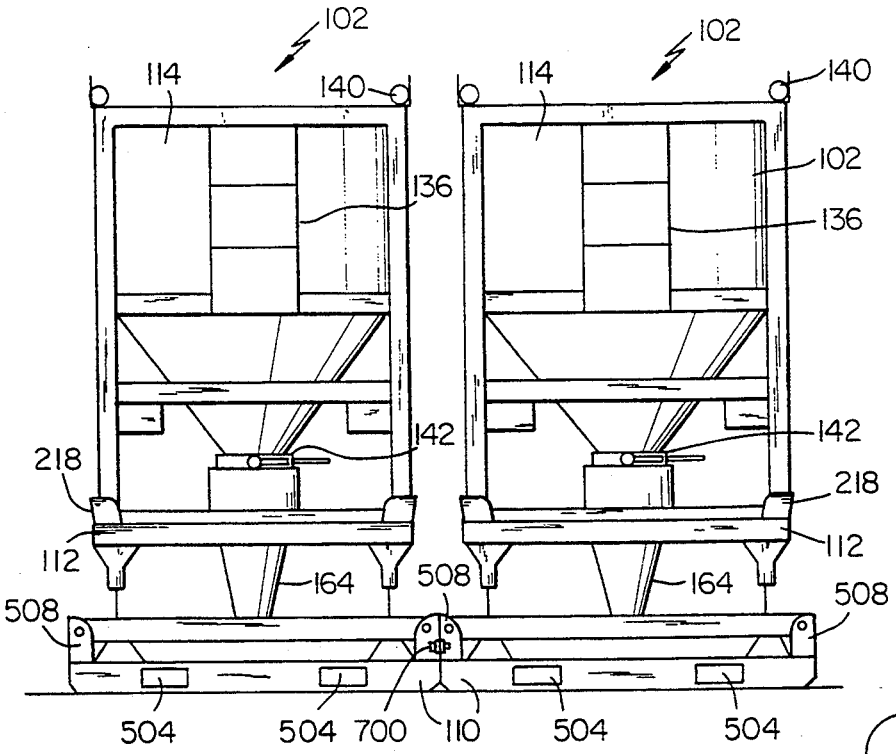
FIG. 7 is a front elevation view of two connected weigh-skids each supporting a respective platform and container.

Note also that, as generally indicated in FIG. 7, two adjacent units 102,102 can be connected to each other by a nut, washer, and bolt assembly 700 mechanically connecting elements 508,508 of the corresponding weigh-skids 110,110.

Figure 6:
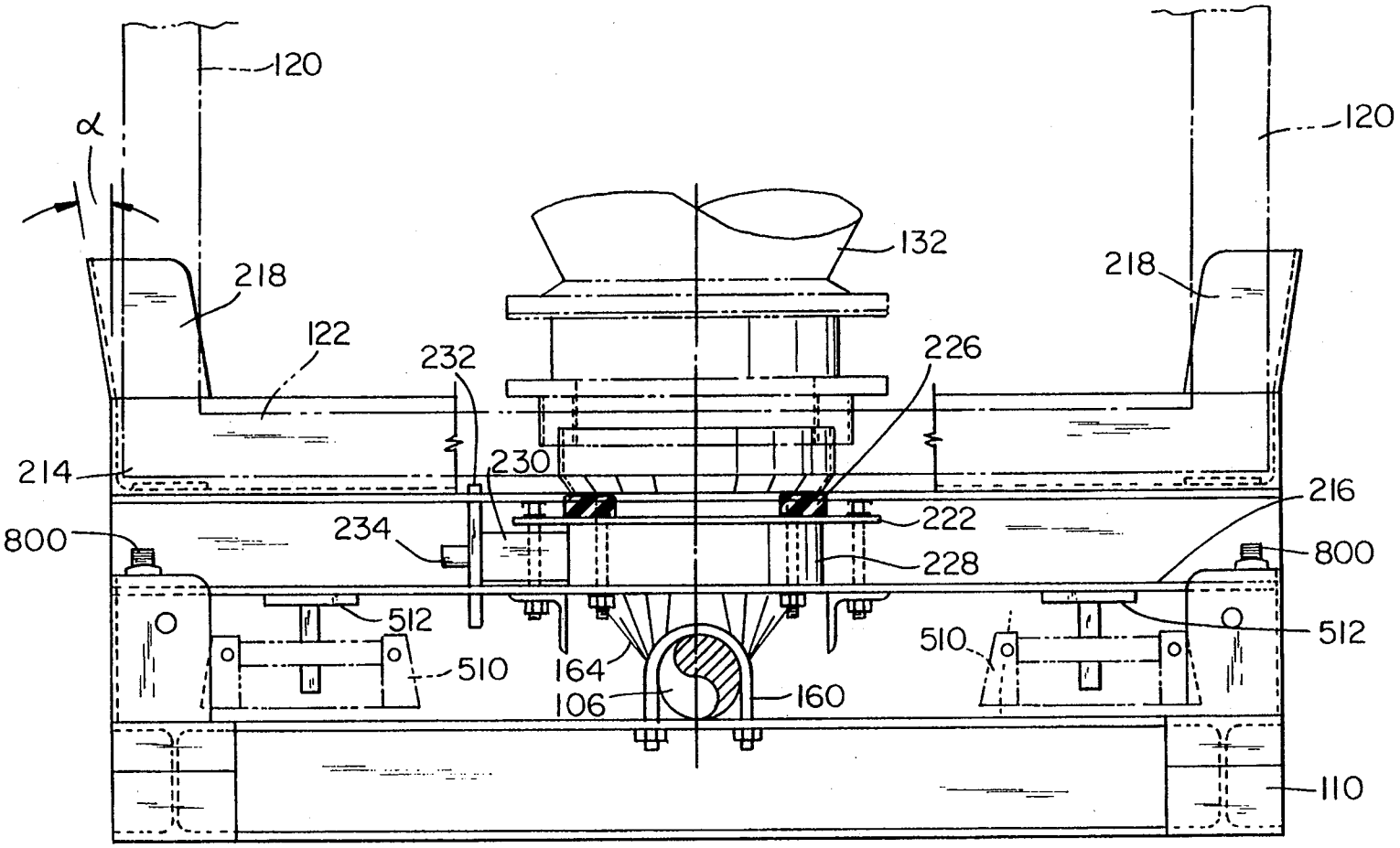
FIG. 6 is a side elevation view of the weigh-skid and platform assembly per FIG. 5.
Figure 10:
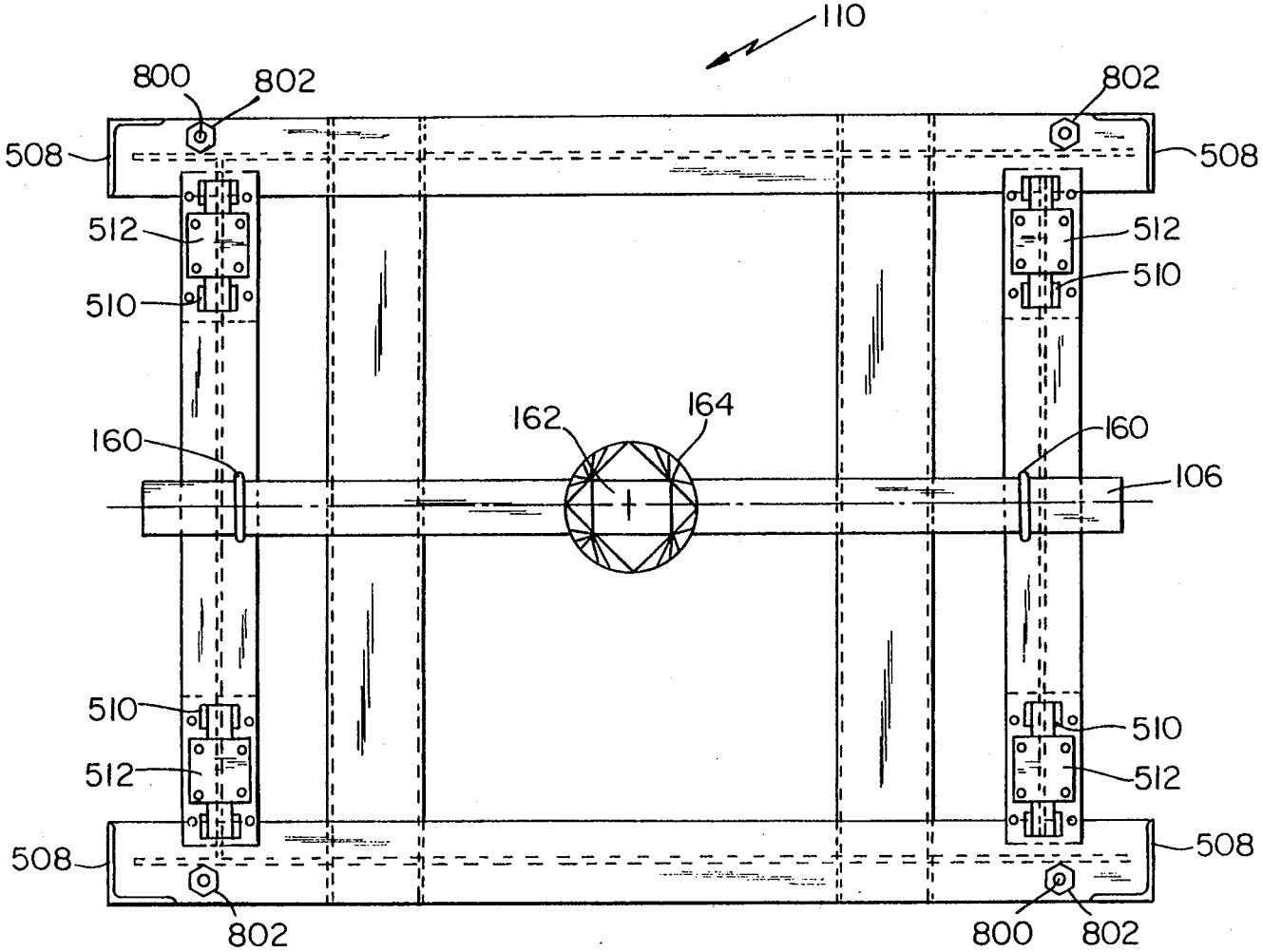
FIG. 10 is a plan view of a weigh-skid of rectangular form, provided with four load cells.

As best seen in FIGS. 6 and 10, a portion of delivery conduit 106 is mounted to an upper portion of weigh-skid 110, and is firmly secured thereto by two C-clamps 160,160. This portion of conduit 106 may be made of a different material, preferably less flexible but stronger material, than the portion extending flexibly away from the cooperating units 102,102,102 and downstream relative thereto, as best understood with reference to FIGS. 1 and 2. Centrally of weigh-skid 110, and at an upper portion of a corresponding central part of the delivery conduit 106 there is provided an opening 162 and, thereabove, a transition junction 164.

As best seen in FIG. 11, cross-beams 220,220 are provided in support base 112 to extend parallel to elongate L-section elements 214,214 and are preferably disposed symmetrically about a center "C" of support base 112. Cross-beams 220,220 support a flat support plate 222 which has an opening 224 centered at center "C" of support base 112. An annular, circular sealing element 226 is adhered to an upper surface of support plate 222 to immediately surround an opening 224 formed therein. Sealing element 226 may be made of any suitable conformable, flexible, and strong commercially-available sealing material, and may be adhered to support plate 222 with any known adhesive material.

For example, a support base 112 about 5 ft.×5 ft., can support a container 114 that weighs about 1250 lbs. empty. A natural gum rubber seal, between 1½ in. to 2 in. thick and of about 41 in. external diameter may be used to provide the desired sealing, and the seal may be conveniently adhered to support plate 222 with a known adhesive. A life expectancy of over two years in normal use can be expected for such a seal arrangement. In such a system, a suitable diameter for the container opening may be about 14 in.

Once a support base 112 is placed in position over the corresponding weigh-skid 110, the transition element 164 is sealingly affixed to a lower surface of support plate 222. Since the support base 112, and support plate 222 attached thereto, may experience some vertical movement when a loaded container 114 is placed thereon, there must be some flexibility provided in the transition element 164 and/or the delivery conduit portion 106 mounted to the corresponding weigh-skid. This can be assured by appropriate selection of materials and form, and any necessary compensation to the weight readings determined by the load cells can be particularly determined and programmed into the operation controls to ensure that correct continual weighing of the granular contents of each unit 102 is possible. Such calibration details are considered to be well within the skills of a person of ordinary skill in the art and a more detailed description thereof is therefore omitted.

Figure 3:
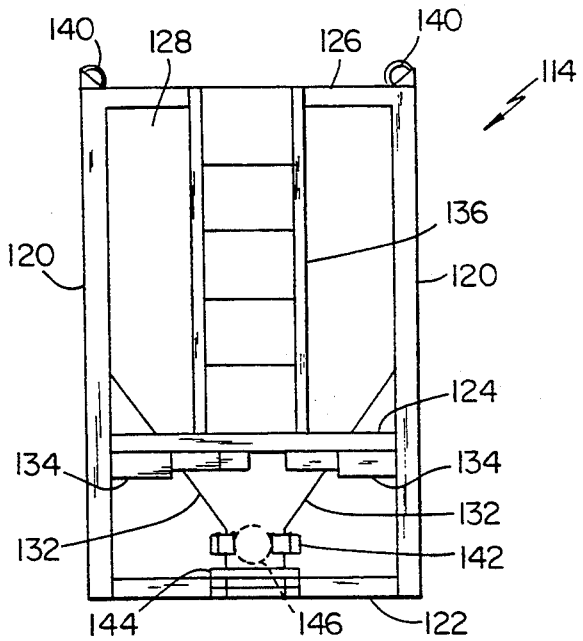
FIG. 3 is a front elevation view of a container of granular materials for use in the system according to FIGS. 1 and 2.

As best seen in FIG. 3, each container 114 is provided with a butterfly valve assembly 142 and a flange 144 therebelow. Thus, when such a container 102 is placed on the support base 112, guided into place by upward, outwardly inclined extensions 218 of the support base 112, a lower surface of flange 144 will sealingly press to and seal against an upper surface of flexible seal 226.

As best seen in FIG. 6, butterfly valve assembly 142 has an outer cylindrical wall 228 to which is provided a short horizontal cylindrical extension 230 ending in a circular flange 232 with a central outwardly extended fitting 234. Any conventional electrical, pneumatic or hydraulic power source can be connected via fitting 234 to operate the butterfly valve contained within the cylindrical housing 228 in known manner. Since such details are considered to be well known in commercially-available butterfly valves and the like, details of the structure and mode of operation thereof are omitted.

The following paragraphs briefly describe the manner in which the above-described system may be operated.

Weigh-skids 110 are first interconnected, as shown in FIGS. 1, 2 and 7. Corresponding support bases 112 are mounted to each of the weigh-skids 110. Corresponding transition elements 164 are sealingly connected to corresponding support plates 222, and nuts 802 and 804 are tightened and/or loosened, as discussed above. The various load cells are connected to electrical connections (not shown for simplicity) which communicate them with a control system including a conventional microprocessor (not shown) having storage capacity to store instructions and data. A conventional display monitor (not shown) may be connected to the microprocessor to enable a user to visually display stored information, process data, and instructions. The microprocessor should be provided with appropriate time signal generating means of conventional kind so that the user can see on the visual display time data, the weights being continually determined by the load cells, and other processed data in meaningful conjunction therewith. A container 102 is mounted on each of the support bases 112 so as to sealingly communicate its butterfly valve assembly 142 to the central opening 224 leading to the corresponding transition element 164 opening through rectangular opening 162 and hence with delivery conduit 106.

If the container 102 has been filled, i.e., loaded, with a suitable quantity of a granular material, the system is ready for operation. In the alternative, as generally indicated in FIGS. 1 and 2, if it is desired that the containers remain in place and not be periodically moved about, an overhead conveyor or a truck-delivery system may be utilized to periodically replenish the respective granular material contained in the various containers 114. In either case, there will come a time when a loaded container 114 is in place and available to supply its granular material contents.

The user then programs the microprocessor with various data. The microprocessor may be a relatively simple, rugged, and inexpensive type dedicated to generating the necessary data, displaying the same, and controlling the few elements that have to be controlled continually. Electrical power supply may be by conventional 120 volts mains power or, if preferred, by a 12 volt direct current.

In order to dispense a predetermined quantity of a granular product from a particular container, the operator needs to start the microprocessor program and identify the particular container and the amount of granular material to be transferred therefrom (in pounds or kilograms). As such data is entered, e.g., by operating a conventional keyboard connected to the microprocessor, the display screen will show that amount. Also, because the necessary load cells are providing weight data to the microprocessor, an appropriate zero-calibration to account for the weight of the empty container 114 and the corresponding support base 112 is preprogrammed, and the screen will also show the amount of granular material available in that container. The operator then enters the time, e.g., in minutes or seconds, during which batches of the selected amount of product are to be delivered at specific selectable rates. The microprocessor will utilize this data not only to determine the amount by which the butterfly valve of the corresponding container 114 is to be opened, but also the timing of such opening and closing, and the start and end times of operation of an auger having a long rotating spirally-bladed element (not shown) mounted in delivery conduit 106 immediately below transition element 164 to positively move the granular material released through the corresponding butterfly valve in a direction for delivery. Any commercially-available auger of suitable size can be mounted in place as described, and the electrical power thereto can be readily controlled by the microprocessor in known manner. A 1 h.p. explosion-proof electrical motor driving such an auger in a 3" diameter delivery conduit can typically move 150 $ft^3$/hr of granular material. Microprocessors are routinely used to turn on and off various electrical devices, e.g., a motor powering such an auger, and the necessary corrections should be well within the ability of persons skilled in the mechanical arts. Successive augers in the streamwise direction of flow may be differently powered or sized as appropriate under operating circumstances and depending on how long a conduit is needed to deliver the granular materials. Such choices must be made in the exercise of conventional engineering judgment by the user.

The operator can provide similar data for the various containers from which selected granular materials at selected rates are to be deposited into and moved along the common delivery conduit 106. Augers having flexible helical driving elements to positively move granular materials are commercially available and are well known. In this manner, predetermined quantities of a plurality of granular materials can be extracted at selected rates and at selected times for delivery through a common delivery conduit to a selected delivery location.

It should be understood that the term "granular material" comprehends generally communinuted material, for example, material that is powdered, particulate, finely divided, grainy, or comprises a range of particle sizes in a dry mixture. For certain applications, the particles may be comprised within a slurry.

As noted earlier, that portion of the common delivery conduit 106 which extends beyond all of the cooperating units 102 of modular system 100 can be made flexible and, within this range, the opening through which the granular materials are emitted from delivery conduit 106 may be selectively moved for delivery to selected locations.

Figure 4:
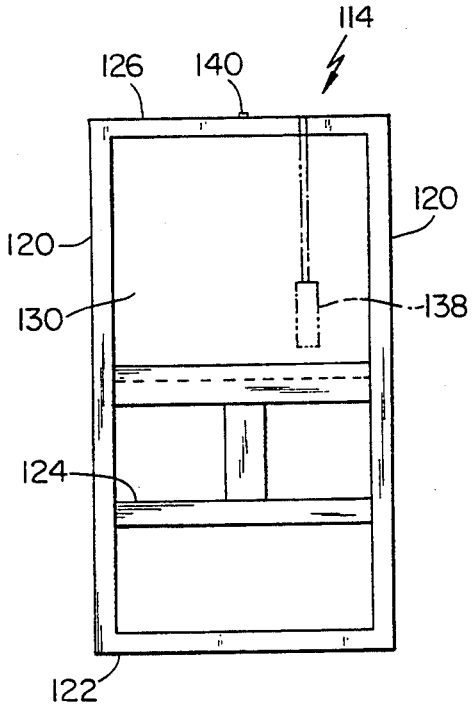
FIG. 4 is a side elevation view of the container of FIG. 3.

Material agitators 138, of commercially-available type and of suitable size and power, as indicated in FIG. 4, may be mounted in the individual containers 114, and power thereto controlled by the microprocessor under control of the user. Again, details of the connection of such elements are considered to be well-understood by persons of ordinary skill in the art, and are therefore omitted.

As will be appreciated, one or more of the containers 102 may contain a liquid carrier material or even a slurry into which granular additives are to be added and mixed. A system with this feature may have appropriately chosen valves and should be operable in generally the same manner as described above, and selected quantities of various granular materials may thus be blended into the liquid carrier or slurry.

An exemplary application is one in which three units are employed cooperatively to produce quantities of drilling mud of varying compositions at different times, depending upon the type of strata through which a drill is being operatively driven. Materials such as bentonite, caustic soda, lignite, barium sulfate, or any known drilling fluid additives may be mixed in selected proportions with water to generate such a mud. The various granular materials may be extracted from respective containers, augered through the common conduit 106, and provided to a selected delivery location 108, as generally indicated in FIG. 1, where a supply of water may be added thereto and the mud mixed in a conventional mixer, after which the mud may be pumped to a well-head where the drill is being operated. With obvious and minor modifications, such a supply of mud may be recirculated and the composition thereof altered by appropriate controls over the supply of granular materials and/or water.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A system for delivering a controlled flow of a granular material, comprising:

container means, having an inlet opening and an outlet opening, for containing a quantity of the granular material;

sealing support means located beneath said container means for sealing to and supporting said container means and granular material contained therein;

weighing means cooperating with said sealing support means only for continually weighing a total weight of said support means with said container means and contents thereof being supported thereon;

material delivery means, cooperating with the container means, the support means and the weighing means, for delivering a predetermined weight of said granular material from said container means to a selected delivery location; and programmable control means for receiving, storing and processing data and instructions from a user relating to said predetermined weight and for controlling said flow of the granular material from the container means to said selected delivery location, whereby the container means is supported solely by resting on the sealing support means.

2. The system according to claim 1, wherein:

said outlet opening is located at a lowest part of said container means and is provided with a valve located in use within said sealing support means, and said container means comprises means for facilitating lifting and movement of the container means to and from the sealing support means.

3. The system according to claim 1, wherein:

said sealing support means comprises a base resting on and supported by said weighing means which comprises a plurality of load cells, said base including a container support flange and an annular sealing element mounted to said sealing support means to be pressed on by said container means to seal said opening to said sealing support means.

4. The system according to claim 1, wherein:

said weighing means comprises a weigh-skid equipped with a plurality of cooperating load cells connected to said programmable control means to continually provide data thereto relating to a total weight determined by said plurality of load cells.

5. The system according to claim 1, wherein:

said delivery means includes means for controlling the outlet opening of the container means to enable a controlled outflow of granular material therefrom, auger means for positively flowing said outflowing granular material toward said selected delivery location, and an annular flexible element mounted to said sealing support means to be pressed on by said container means for sealing said sealing support means to said container means.

6. The system according to claim 5, further comprising:

a flexible material delivery conduit having a material-receiving end, connected to and cooperating with said material delivery means to receive a controlled flow of granular material therefrom, and a movable delivery end.

7. The system according to claim 1, further comprising:

material agitating means for agitating said granular material contained in said container means to facilitate an outflow of the granular material.

8. The system according to claim 1, wherein:

said control means comprises microprocessor means which includes means for receiving data and instructions from a user, means for timing a start and an end of a flow of said granular material from said container means, and means for displaying input data and instructions and computed data relating to an outflow of granular material from said container means and an amount of granular material contained in said container means at a selected time.

9. The system according to claim 1, wherein:

said sealing support means comprises a flexible annular sealing element disposed in use between the container means and the sealing support means.

10. A programmable modular system for delivering individually controlled and correlated flows of a plurality of separately contained granular materials, comprising:

a plurality of cooperating units, each unit including a container means for containing a replenishable quantity of a corresponding granular material, a sealing support means for sealing to and supporting said container means with said corresponding granular material contained therein, weighing means cooperating with said sealing support means only for continually weighing a total weight of said sealing support means with said container means and contents thereof supported thereon, and delivery means cooperating with said container means for receiving therefrom said corresponding granular material and delivering the same to a selected delivery location; and programmable control means communicating with and controlling said plurality of units, for receiving, storing and processing data and instructions from a user relating to said flows of respective granular materials from said units, and for separately controlling flows of respective granular materials from the container means of each of said plurality of units through corresponding delivery means for delivery of said respective granular materials to said selected delivery location, whereby each of the container means is supported solely by resting on a respective sealing support means.

11. The programmable system according to claim 10, wherein:

each of said container means comprises a container having an inlet opening at an upper surface, an outlet opening provided with a valve at a lower portion, and means to facilitate lifting and movement of the container to and from corresponding support means.

12. The programmable system according to claim 10, wherein:

said sealing support means of each of said units comprises a base resting on and supported by said weighing means which comprises a respective plurality of load cells, each of said sealing support means also including a container support flange and an annular sealing element mounted to said sealing support means to be pressed on by said container means to seal said opening to said sealing support means.

13. The programmable system according to claim 12, wherein:

said container means of each of said units comprises a valve controlled by said control means to regulate corresponding timing, rate and duration of controlled flow of corresponding granular material therefrom.

14. The programmable system according to claim 12, wherein:

said support means of each of said units comprises respective guide means for guiding a lower portion of a corresponding container means to a sealingly fitted position on said support flange.

15. The programmable system according to claim 10, wherein:

said weighing means of each of said units comprises a respective weigh-skid equipped with a plurality of cooperating load cells connected to said programmable control means to continually provide data thereto regarding a total weight determined by said plurality of load cells.

16. The programmable system according to claim 10, wherein:

said delivery means of each of said units includes means for controlling an outlet opening of the corresponding container means thereof to enable an outflow of a corresponding granular material therefrom, auger means for positively flowing said outflow of corresponding granular material toward said selected delivery location.

17. The programmable system according to claim 16, wherein:

said delivery means of each of said units communicates with a shared, flexible delivery conduit having a movable delivery end located at said selected delivery location.

18. The programmable system according to claim 17, wherein:

said delivery means of each of said units comprises an individual auger controlled by said control means.

19. The programmable system according to claim 10, wherein:

said control means comprises means for receiving input data and instructions from the user, means for continually receiving, storing and processing weight-related data from said weighing means, timing means for timing respective start and end times for deliveries of said granular materials from said cooperating units, and means for controlling respective outflows of said corresponding granular materials from each of said units for delivery thereof by the corresponding delivery means of said plurality of cooperating units to said selected delivery location.

20. The programmable system according to claim 10, further comprising:

in each of said units a respective material agitating means for agitating a corresponding granular material contained therein to facilitate an outflow thereof.

21. The programmable system according to claim 10, wherein:

said sealing support means comprises a flexible annular sealing element disposed in use between the container means and the sealing support means.

22. A method of programmably supplying a flow of a granular material to a selected changeable location, comprising the steps of:

containing a quantity of said granular material in container means having an inlet opening and an outlet opening;

supporting said container means solely by resting the same on a support means having an annular flexible element so as to permit controlled opening of said outlet opening to obtain an outflow of said granular material through said outlet opening while sealing with the annular flexible element against and around the outlet opening of the container means to prevent emission of dust to the ambient atmosphere during the outflow;

continually weighing said support means, with said container means and contents thereof supported by said support means, whereby a weight of said outflow of granular material can be determined; and controllably transferring said outflow of granular material, in accordance with a predetermined supply program, to a selected changeable location.

23. The method according to claim 22, comprising the further step of:

agitating said granular material contained within said container means to facilitate said outflow thereof.

24. The method according to claim 22, comprising the further step of:

programming a control means to control a timing and an extent of opening of said outlet opening to obtain predetermined rates of flow of said granular material at selected times, to thereby obtain said selected weight of outflowed granular material and said transfer thereof to said selected changeable location.

25. A method of programmably supplying individually controlled flows of a plurality of granular materials, comprising the steps of:

containing said plurality of granular materials in a respective plurality of container means each having an inlet opening and an outlet opening;

supporting said plurality of container means solely by resting each on respective support means so as to permit controlled opening of respective outlet openings of the container means to obtain corresponding outflows of the respective granular materials contained therein;

continually weighing each of said plurality of container means and granular materials respectively contained therein, with each of the container means resting on and supported solely by corresponding support means located underneath, whereby respective weights of said respective outflows of said granular materials from said containers can be continually determined and controlled; and controllably obtaining and transferring said outflows of granular materials from said plurality of container means in accordance with a predetermined supply program to a selected changeable location.

26. The method according to claim 25, comprising the further step of:

providing and operating respective agitating means to agitate said granular materials contained in said plurality of container means to facilitate respective outflows thereof.

* * * * *